US005171358A

United States Patent [19]

Mourer

[11] Patent Number: 5,171,358

[45] Date of Patent: Dec. 15, 1992

[54] APPARATUS FOR PRODUCING SOLIDIFIED METALS OF HIGH CLEANLINESS

[75] Inventor: David P. Mourer, Danvers, Mass.

[73] Assignee: General Electric Company, Cincinnati, Ohio

[21] Appl. No.: 787,986

[22] Filed: Nov. 5, 1991

[51] Int. Cl.[5] ..... C22B 4/00

[52] U.S. Cl. ..... 75/10.19; 75/10.23; 75/584; 266/227

[58] Field of Search ..... 75/10.19, 10.23, 584; 266/227-230

[56] References Cited

U.S. PATENT DOCUMENTS

| | | | |
|---|---|---|---|
| 2,618,013 | 11/1952 | Weigand et al. | 18/2.5 |
| 3,099,041 | 7/1963 | Kaufmann | 18/2.6 |
| 3,342,250 | 9/1967 | Treppschuh et al. | 164/50 |
| 3,658,119 | 4/1972 | Hunt | 164/512 |
| 3,764,297 | 10/1973 | Coad | 75/10.23 |
| 3,814,167 | 6/1974 | Listhuber | 75/584 |
| 3,826,598 | 7/1974 | Kaufmann | 425/7.65 |
| 4,067,674 | 1/1978 | Devillard | 425/8 |
| 4,218,410 | 8/1980 | Stephan et al. | 264/8 |
| 4,295,808 | 10/1981 | Stephan et al. | 425/8 |
| 4,544,404 | 10/1985 | Yolton et al. | 75/0.5 |
| 4,966,201 | 10/1990 | Svec et al. | 138/141 |

FOREIGN PATENT DOCUMENTS

| | | |
|---|---|---|
| 54-442 | 1/1979 | Japan . |
| 57-75128 | 5/1982 | Japan . |
| 1296288 | 11/1972 | United Kingdom . |
| 1514379 | 6/1978 | United Kingdom . |
| 1529858 | 10/1978 | United Kingdom . |
| 2117417A | 10/1983 | United Kingdom . |
| 2142146B | 1/1987 | United Kingdom . |

*Primary Examiner*—Peter D. Rosenberg
*Attorney, Agent, or Firm*—Jerome C. Squillaro; Carmen Santa Maria

[57] ABSTRACT

An apparatus for producing solidified metals of high cleanliness removes floating matter such as oxides from the surface of molten metals prior to melt atomization. The apparatus includes a water-cooled melt vessel having a dam extending from a sidewall of the vessel at an acute angle to the sidewall. The dam extends above a preselected metal surface level of the interior of the vessel to form a floating matter trap region within the apex of the acute angle. There is a passageway through the dam sufficiently remote from the trap region that floating matter in the trap region is not in communication with the passageway. The passageway may be entirely below the metal surface level or extend from below the metal surface level to above the metal surface level, but sufficiently far away that floating matter can be forced away from the passageway, as by the herding action of a plasma torch. A receptacle may be placed adjacent to the trap region so that the floating matter can be directed into the receptacle and removed from the melt surface.

25 Claims, 3 Drawing Sheets

APPARATUS FOR PRODUCING SOLIDIFIED METALS OF HIGH CLEANLINESS

BACKGROUND OF THE INVENTION

This invention relates to melt processes for the production of clean metals, and, more particularly, to reducing the content of oxides and other low-density substances in the metallic articles made from such metals.

An increasingly important method for the fabrication of metallic articles for critical applications is powder processing. In this approach, fine powder particles of the metallic alloy of interest are first formed. The proper quantity of the particulate or powdered material is placed into a mold or container and compacted by hot or cold isostatic pressing, extrusion, or other means. This powder metallurgical approach has the important advantage that the microstructure of the product produced by powder consolidation is typically finer and more uniform than that produced by conventional techniques. In some instances, the final product can be produced to virtually its final shape, so that little or no final machining is required. Final machining is expensive and wasteful of the alloying materials, and therefore the powder approach to article fabrication is often less expensive than conventional techniques.

The prerequisite to the use of powder fabrication technology is the ability to produce a "clean" powder of the required alloy composition and quality on a commercial scale. The term "clean"refers to an absence of inclusions of foreign substances in the solidified metal. Numerous techniques have been devised for powder production. One of these techniques is the melt atomization process. In the melt atomization process, a melt of the alloy of interest is formed, and a continuous stream of the alloy is produced from the melt. The stream is atomized by a gas jet or a spinning disk, producing solidified particles that are collected and graded for size. Particles that meet the size specifications are retained, and those that do not are recycled through the system for remelting and reprocessing into powder.

When the alloy is melted in a melt vessel such as a hearth prior to atomizing it into powder, an oxide raft typically forms on the surface of the melt, even when an inert atmosphere or vacuum is maintained over the melt. This oxide is present as a result of oxidation of the melt, prior processing of the alloy in ceramic containment vessels, and other reasons. Some or all of the oxide may be swept along with the melt into the atomization apparatus, resulting in the inclusion of oxide particles within, or mixed with, the metallic particles. The oxide particles are processed into the final articles along with the metal, and incorporated into the articles.

The presence of the oxide particles is usually deleterious to the properties of the final articles produced from the powder particles. The oxide particles can either be crack initiation sites or assist in crack propagation, leading to premature failure of the article. Since the oxide particles cannot be readily removed from the powder mix or the articles, it is important to prevent the oxide from entering the atomization process in the first place.

There are two possible approaches to preventing oxides from entering the final articles. One is to prevent or control the formation of oxides or oxide rafts, and the other is to permit the oxides or oxide rafts to form, but to prevent the oxides from reaching the atomizer.

Various techniques such as atmosphere composition control have been used in an attempt to prevent formation or cause reduction of the oxide in the first place, but the thermodynamics of oxide formation dictates that the oxides can form even in the presence of very small oxygen contents. Atmosphere control to reduce oxides is, in many cases, impractical because of its adverse effects on the overall production operation and costs, and on the final product.

Another approach is to permit oxides or oxide rafts to form, and then prevent it from reaching the powder. Since oxides and other types of ceramic impurities have densities that are less than that of the metallic alloys that are melted, they float on the surface of the melt typically as agglomerated rafts of particles. In one such technique, the surface-applied heat source is used to "herd" the oxide rafts away from the pouring spout of the hearth, reducing the likelihood that oxide will pass through the spout to the atomization process. The rafts can be herded behind dams placed across the metal surface.

Although herding of the oxide rafts has met with some success, such herding becomes progressively more difficult as additional oxide forms during the melting process. Various techniques have been tried to periodically skim the oxide rafts from the surface of the melt, but these have not been entirely successful. Oxide inclusion in powders prepared by melt atomization remains a problem, particularly for extended powder production runs.

The problem of cleanliness of the molten metal has been discussed in relation to powder production. However, the same problem arises in relation to the preparation of ingots of high cleanliness. There is therefore a need for a better approach to preventing oxides from being incorporated into molten metals. The present invention fulfills this need, and further provides related advantages.

SUMMARY OF THE INVENTION

The present invention provides an apparatus and method for reducing the oxide content of powder particles produced by the melt atomization process. The approach focuses on removing the oxide raft after it forms but before it can reach the atomizer, rather than preventing the formation of the oxide. There is consequently little effect on process economics, as would be required if highly specialized atmosphere controls were used. The approach is operable for indefinitely extended production runs, permitting the oxide to be periodically removed before its amount becomes too large to manage effectively. Articles produced using the approach of the invention have reduced oxide contents as compared with prior approaches, and are therefore of higher quality.

In accordance with the invention, apparatus for producing solidified metal of high cleanliness includes a melt vessel having walls with cooling passages therein and having first and second opposing sidewalls. A dam extends at an acute angle from the first sidewall of the melt vessel. The dam extends above a preselected level of the interior of the vessel to form a floating matter trap region within the apex of the acute angle, and has a passageway therethrough sufficiently remote from the trap region that floating matter in the trap region is not in communication with the passageway. The apparatus further includes means for producing solidified metal, and means for transferring molten metal from the melt vessel to the means for producing solidified metal.

Floating matter, primarily oxide rafts, present on the surface of the melt in the melt vessel is captured behind the dam and guided to the trap region in the acute angle formed between the dam and the sidewall. The movement of the oxides and oxide rafts can be facilitated by the proper operation of a surface-applied heating source. That is, the plasma torch or electron beam can be played over the surface of the melt in such a manner that the oxides are herded toward the trap region. A floating matter receptacle communicating with the trap region, as by a notch in the sidewall of the melt vessel, can receive oxide accumulated in the trap region and permanently remove it from the melt surface.

The dam can extend across all or part of the width of the melt vessel as a straight obstacle, when viewed in a plan view. It can also be made in the form of a V whose two legs meet the opposing sidewalls at acute angles, thereby providing a trap region at each side of the vessel. The elevational appearance of the dam can also be varied by extending it to various depths below the surface of the melt or providing passages through the dam either above or below the surface of the melt. Whether the passageway is above or below the surface of the melt, the passageway must be sufficiently remote from the trap region that oxide from the trap region cannot find its way around the dam through the passageway. The passageway thus can be, for example, the space below a dam which is at the surface and some small distance below the surface, or an opening through a dam which entirely fills a section of the vessel.

The melt vessel can be a hearth, a pouring trough, or some other part of the melting system through which the metal flows. In most such vessels, there is an inflow opening through which molten metal flows into the vessel, and an outflow opening through which molten metal flows out of the vessel. It is often helpful to place the inflow and outflow openings asymmetrically with respect to the longitudinal centerline between the sidewalls to facilitate oxide removal to the trap region of the dam.

The apparatus of the present invention permits the production of solidified metal having high cleanliness, being substantially free of impurities. The metal is introduced into a first end of the melt vessel. The melt vessel has a dam which is water-cooled, extending from a first sidewall of the vessel toward a second, oppositely disposed sidewall. The dam extends at least partially across the surface of the molten metal in the vessel toward the opposite sidewall, although it preferably extends completely to the oppositely disposed sidewall. The dam preferably forms an acute angle with at least one sidewall so that the apex of the angle formed by the sidewall and the dam is the furthest point of the angle from the first end of the melt vessel, that is to say, the apex is downstream as the molten metal flows from the first end of the melt vessel to the discharge point, which preferably is at the second end of the vessel. This acute angle forms a trap region to capture impurities floating on the surface of the molten metal, such as oxides and oxide rafts. The captured impurities may be removed from the trap region into an optional receptacle.

The metal is melted or, if introduced in the molten state, kept molten within the melt vessel by heating source, such as a plasma torch or an electron beam gun, which maintains the metal at the desired temperature. As the molten metal flows from the first end to the second end, it passes the trap region, which captures the floating impurities. Optionally, the heat source, which may be movable, can be used to herd the impurities into the trap region. The molten metal is discharged from the vessel downstream from the trap region, preferably at the second end and preferably through a passageway sufficiently remote from the trap region so that impurities from the trap region do not flow from the trap region to block the passageway. The entire operation is performed in a protective atmosphere, such as an inert gas atmosphere or under a vacuum.

In another embodiment, the metal is melted by a separate melting source and is introduced into the melt vessel, such as by pouring a stream of molten metal from the melt source into the melt vessel.

The present approach produces powder particles and other forms of solidified metal, such as billets or ingots, having lower oxide contents than those produced using other approaches. Little change is required in the melt vessel construction to incorporate the angled dam and optional floating matter receptacle, but the improvement in quality of the final product is substantial. Other features and advantages of the invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENTS

Figure 1:
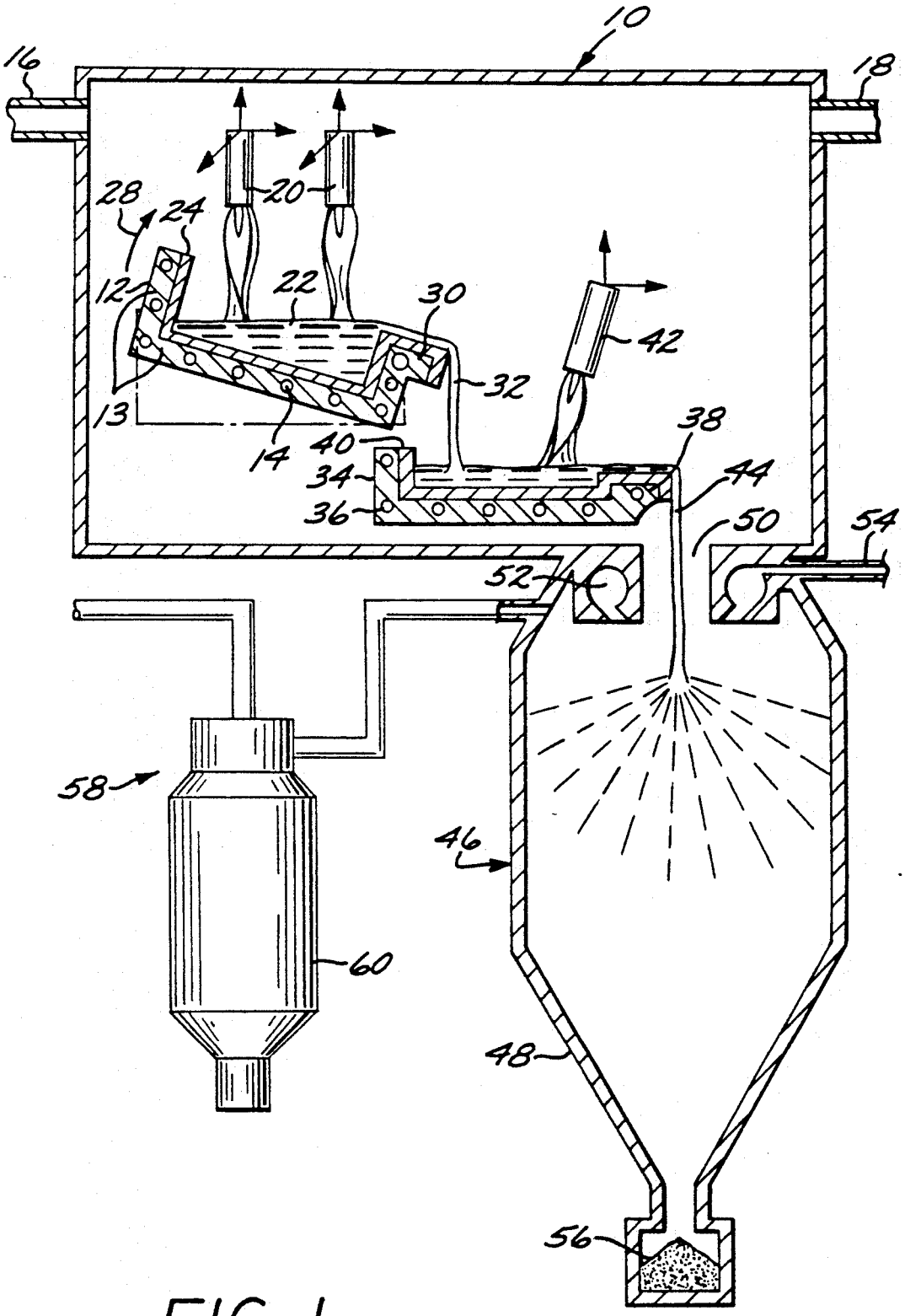
FIG. 1 is a sectional of an apparatus for producing powder particles.

An apparatus for producing powder particles is illustrated in FIG. 1. This apparatus is discussed in published UK patent application no. 2,142,046A.

A chamber 10 contains a fluid-cooled hearth 12 including walls 13 having fluid-cooling passages 14 therein connected with a source of cooling fluid such as water (not shown). As used herein, the term "wall" or "walls" may include the base or floor as well as the side walls, as desired, of the member being described. The melting chamber 10 can be adapted to enclose a desired atmosphere or pressure condition, as for example by introducing an inert gas such as argon through a gas inlet 16, to be evacuated through a gas outlet 18. Disposed above the hearth 12 is a surface heating source directed toward the hearth, such as an illustrated plasma heat source 20 shown in the drawing as a plurality of plasma torches. With a metallic material 22 introduced into the hearth 12, the plasma heat source 20 is adapted to initiate and further the melting of such materials. When movable, the plasma heat source 20 is adapted to sweep over a surface of the metallic melt.

During the operation of the above-described melting means, the metallic alloy material 22 is disposed in the hearth 12. Such introduction can be in a batch-type process or can be in a continuous or semicontinuous process employing a supplementary metal feed system of a type well known in the art. For example, a chute and feed mechanism of the type, shown in Bomberger, Jr. et al. U.S. Pat. No. 3,744,943 issued Jul. 10, 1973, can be used. The disclosure of that patent is incorporated herein by reference.

With cooling fluid such as water circulating within the cooling passages 14, the plasma heat source 20, such as a battery of movable plasma heat torches, is placed in operation. In this embodiment, the torches are moved to sweep a surface of the material 22 in the hearth 12 to melt such material. As molten material contacts the cooled inner wall of the hearth 12, the molten material resolidifies into a hearth skull 24 which acts as a barrier or buffer between the hearth walls and other melted material and alloy in the hearth. In this way, hearth material is prohibited from being introduced into the molten alloy within the hearth and a reservoir of molten alloy is provided substantially free of foreign materials.

After a desirable level of melting and superheat is achieved, the hearth is tipped such as about a pivot point using a tipping means or mechanism represented by an arrow 28. Molten alloy in the hearth, remaining from that material which was resolidified to form the skull 24, is discharged or poured from the hearth, conveniently from a hearth lip 30 to provide a molten metal stream 32. In the drawing, according to one form of the present invention, the molten metal stream 32 is poured into a stream control device in the form of a fluid-cooled trough 34 for supplemental handling. However, it should be understood that molten metal stream 32 can be introduced into any of several other stream control devices of a type apparent to those skilled in the art or directly into a powder metal producer.

Equivalently, two or more vessels or hearths may be arranged so that the molten alloy material is continuously melted, and the melt proceeds from one hearth to the next. The melt can flow from hearth to hearth through a notch in a wall of the hearth, a subsurface bottom-pouring spout, or a tilting mechanism.

In the form of the invention shown in FIG. 1, the molten metal stream 32 is introduced into the stream control device comprising the fluid-cooled trough 34 which includes fluid-cooling passages 36 supplied from a cooling fluid source such as water (not shown) in a manner well known in the art. Similar to the hearth 12, the trough 34 can include a lip 38 to assist the flow of molten metal from the trough 34.

In operation, the trough 34 receives molten alloy in the stream 32 from the hearth 12 while cooling fluid is circulated through the cooling passages 36. As the molten metal contacts the cooled walls of the trough, a portion of the molten metal solidifies forming a trough skull 40 similar to the hearth skull 34. The skull 40 functions in the same manner, as a barrier or buffer between the walls of the trough 34 and the molten alloy maintained in the trough after solidification of the trough skull. To maintain such additional alloy in the trough in the molten state, a secondary heat source such as shown in the drawing as a plasma heat torch 42 may be desired or required. During operation, the secondary plasma heat source 42 is directed at the additional molten alloy in the trough remaining from that which has resolidified as the trough skull 40.

A stream 44 of molten alloy flows from the trough 34 into a means for producing solidified metal, illustrated in FIG. 1 as a powder metal producer 46. The present invention is also operable with other types of devices for producing solidified metal from the molten stream, such as, for example, ingot production equipment. In such devices, the molten metal of the stream 44 is not atomized to form powder, but is directed onto a cooled substrate to form an ingot whose size is progressively enlarged as more molten metal is solidified.

A metal powder producer 46 can be of a variety of types well known in the art, for example atomization or other disintegration type devices which produce metal powders. FIG. 1 shows diagrammatically one of the gas atomization type which includes a cooling tower 48 having a molten metal inlet 50 about which is disposed an atomizing gas spray means 52 to inject atomizing gas such as argon, nitrogen, helium etc., into the molten metal stream 44 entering the cooling tower 48 through the inlet 50. Such an atomizing gas is fed through a conduit 54 from a pressurized gas source (not shown). The atomizing gas thus introduced into the molten alloy stream causes the stream to disperse into small particles which solidify and fall to the bottom of the cooling tower 48 to be collected in metal powder collector 56. Equivalently, atomization of the metal stream can be accomplished by impinging the stream against a spinning disk or cup that causes the stream to disintegrate. As shown in FIG. 1, it is convenient to include with such a powder metal producer an exhaust system shown at 58. Generally, the exhaust system includes a fines or dust collector 60, for example of the cyclone collector type well known in the art.

If desired, supplemental heat sources can be used in the melting chamber 10, for example directed at the hearth lip 30 or at the trough lip 38, or both. This can assist the molten alloy streams 32 and 44 to pour in a desired molten condition or superheat.

Metallic oxide forms on the surface of the molten metal in the hearth 12 and the trough 34, and the present invention provides a means to prevent that oxide from flowing into the powder producer 46. That means includes a dam across the melt vessel. Such an approach can be used in conjunction with the hearth 12, the trough 34, a separate intermediate refinement vessel, or any combination thereof. The following discussion presents the approach in conjunction with a generalized melt vessel 100, and it will be understood that such a vessel can be the hearth 12, the trough 34, or some other vessel through which the molten metal flows.

Figure 2:
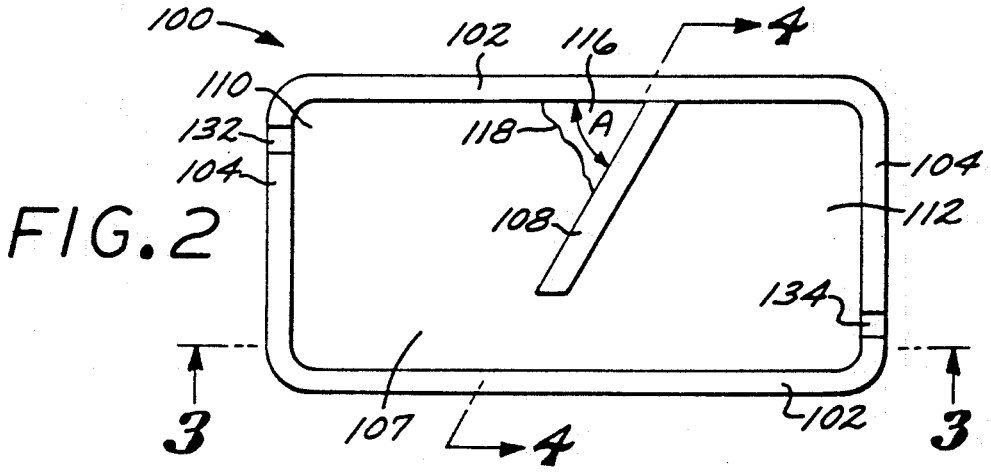
FIG. 2 is a plan view of a melt vessel having a dam therein.
Figure 3:
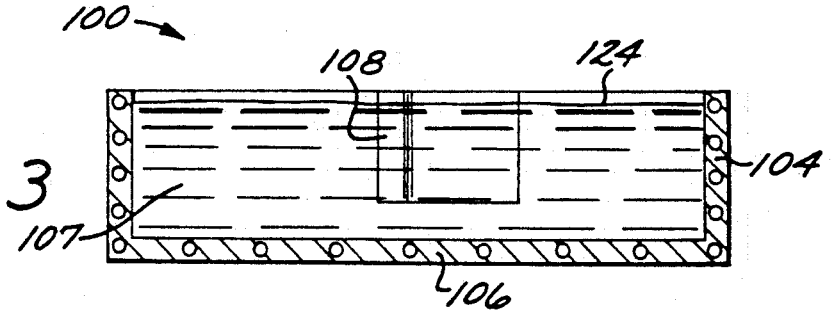
FIG. 3 is a sectional view of the melt vessel of FIG. 2, taken along lines 3—3.
Figure 4:
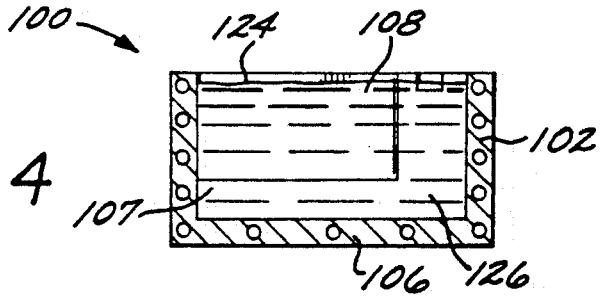
FIG. 4 is a sectional view of the melt vessel of FIG. 2, taken along lines 4—4.

A melt vessel 100 of FIGS. 2–4 includes two opposing sidewalls 102, two opposing endwalls 104, and a bottom 106. A molten metal melt 107 is contained within the melt vessel 100. A dam 108 extends from one of the sidewalls 102, at least a portion of the distance across the melt vessel 100 to an opposing sidewall. In another embodiment illustrated in FIG. 5, the dam 108 extends across the entire width of the melt vessel 100, from sidewall to sidewall.

The dam 108 meets the sidewall 102 from which it extends at an acute angle A of from more than 0 to less than 90 degrees, more preferably an angle of from about 45 to about 70 degrees, and most preferably at an angle of about 60 degrees. The acute angle A is measured with reference to an inflow end 110 of the vessel 100 at which metal is added to the melt vessel 100, rather than an outflow end 112 from which metal is removed from the melt vessel 100. (In the embodiment of FIG. 5, there is a supplementary obtuse angle 0 at the opposing end of the dam 108. Such an obtuse angle is acceptable, as long as there is an acute angle A at at least one end of the dam.) In another embodiment shown in FIG. 6, the dam 108 is in the form of a "V" having two legs 114 that each extend from one of the sidewalls 102 at an acute angle A (which need not be the same angle at both ends).

At the apex of each acute angle A between one of the sidewalls 102 and the dam 108 there is a trap region 116 toward which floating material such as oxide particles or rafts on the surface of the melt 107 can move and be trapped for subsequent removal from the melt vessel 100. The movement of the floating material can be natural as a result of the movement of, and currents in, the melt 107. More typically, the floating material is "herded" toward the trap region 116 by the progressive movement of the surface heating source, such as the torches 20 or 42 of FIG. 1. A floating oxide or agglomeration of floating oxides (termed an oxide raft) is pushed away from the gas pressure of a heating source, and the movement of the heating source can therefore be used to direct the floating movement of the floating material toward the trap region 116.

A floating mass of oxide, numeral 118, accumulates in the trap region 116 within the acute angle A near its apex. That mass of oxide 118 can be removed by a skimming technique. More preferably, the oxide mass 118 is removed to a floating matter receptacle 120, illustrated in FIGS. 5 and 6, fastened to the outer surface of the sidewall 102 near the apex of the acute angle A. A notch 122 is provided in the sidewall 102 to guide the oxide mass 118, usually mixed with a small amount of the molten metal, over the sidewall 102 and into the receptacle 120. The level of molten metal in the melt vessel 100 is preselected, and is preferably controlled to be slightly below the bottom of the notch 122. When oxide mass 118 is to be periodically removed, the level of the molten metal in the melt vessel can be temporarily raised to permit the oxide mass 118 to float through the notch, or the oxide mass 118 can be herded through the notch with the movement of the plasma torch directed downwardly against the upper surface of the melt 107.

The dam 108 can have any of several forms. In the embodiment of FIGS. 2–4, the dam 108 is a substantially straight (in a plan view), water-cooled metal piece that extends part of the way from one sidewall toward the other (FIG. 2). Although it might be possible for some of the floating oxide to pass around the end of the dam 108 of this embodiment, the surface heating torch can be used to herd the oxide toward the trap region so that it cannot bypass the dam 108. The top of the dam 108 reaches slightly above the level of a surface 124 of the melt 107, but does not extend all of the way down to the bottom of the vessel 100. The area below and to the open side of the dam 108 constitutes a passageway 126 through which molten metal flows from the inflow end 110 to the outflow end 112. Because the dam is water-cooled, a metal skull will build up on it. However, the dimensions are selected so as not to impede the flow of molten metal.

Figure 5:
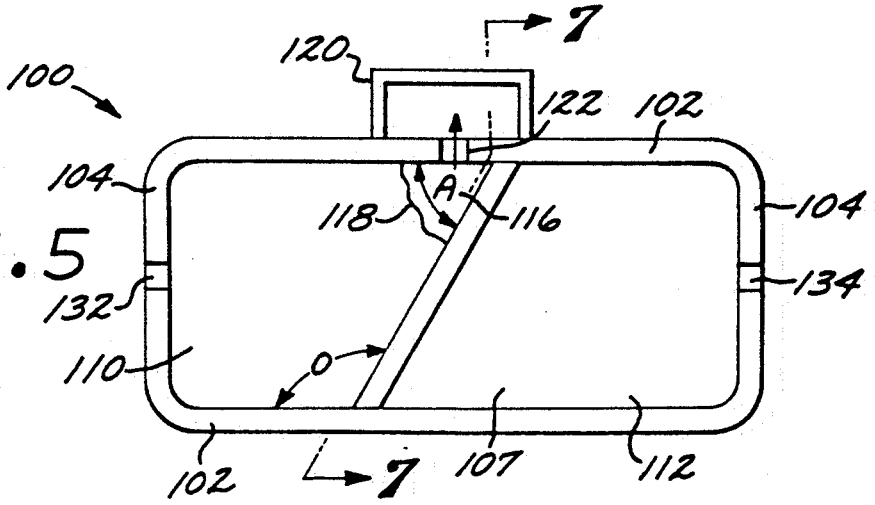
FIG. 5 is a plan view of another embodiment of the melt vessel.
Figure 7:
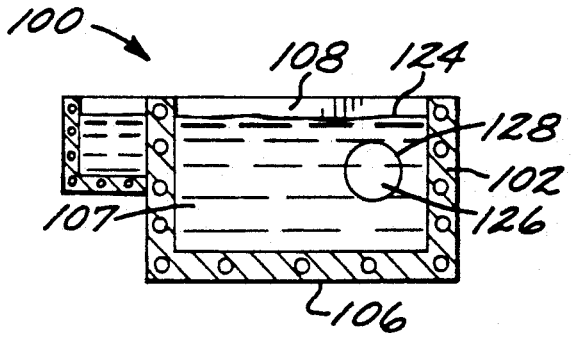
FIG. 7 is a sectional view of the melt vessel of FIG. 5, taken along lines 7—7.
Figure 8:
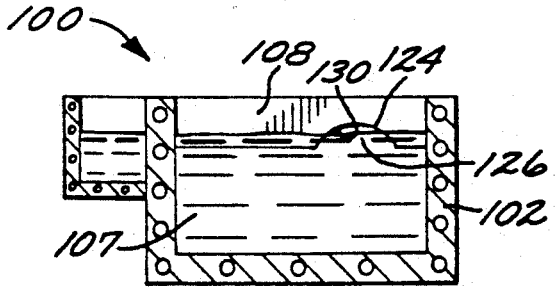
FIG. 8 is a sectional view similar of the melt vessel of FIG. 5, taken along lines 7—7.

In another form of the dam 108, illustrated in FIG. 5, the dam 108 extends across the entire width of the melt vessel, but not all of the way to the bottom of the melt vessel. In another embodiment illustrated in FIG. 7, the dam 108 extends across the entire width of the melt vessel 100, and from above the melt surface 124 to the bottom 106 of the vessel 100. The passageway 126 in this case is an opening 128 through the dam 108, entirely below the surface of the melt 124. In another embodiment illustrated in FIG. 8, the dam 108 extends the entire width of the vessel 100, from above the surface of the melt 124 to some depth below the surface. The passageway 126 is found in the region below the dam 108, but also through a cutout 130 that extends from below the surface of the melt 124 to above the surface 124. As with the case where the dam does not extend the entire width, here the oxide must be prevented from flowing through the dam by the herding action of the heating source. In each embodiment, the dam is water-cooled, and the dimensions are selected so that the resultant metal skull formed on it does not impede metal flow from the inflow end 110 to the outflow end 112. These embodiments are meant to be illustrative, and not exclusive, and features of the various structures can be intermixed as may be appropriate between various embodiments.

A key point is that the passageway 126 through or around the dam 108 must be sufficiently remote from the trap region that floating oxide 118 or other floating matter in the trap region is not in communication with the passageway. That is, the passageway must be below the surface of the melt 124 so that floating matter does not reach the passageway, or, if the passageway is above the surface, sufficiently far from the trap region 116 that the plasma torch or other surface heating means can be effectively used to herd the floating matter away from the passageway.

Figure 6:
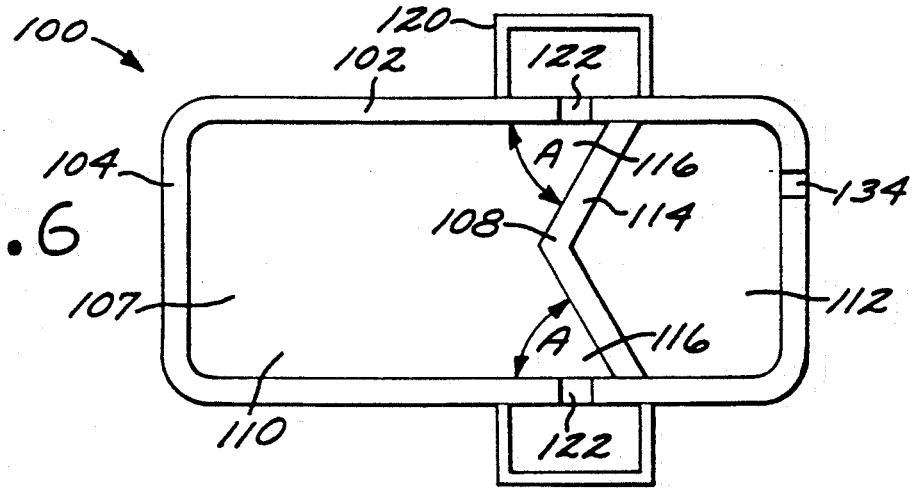
FIG. 6 is a plan view of another embodiment of the melt vessel.
Figure 9:
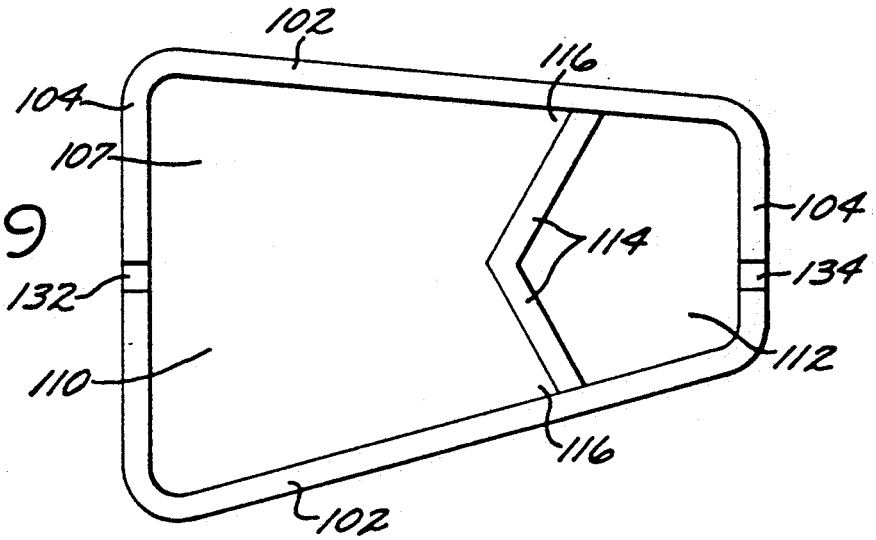
FIG. 9 is a plan view of another embodiment of the melt vessel, with nonparallel sidewalls.

Molten metal can be added to the melt vessel 100 either from above into the inflow end 110, or through an inflow opening 132 in the form of a notch or cutout in a sidewall 102 or, more typically, an endwall 104. Similarly, the molten metal can be removed from the outflow end 112 of the melt vessel 100 through an outflow opening 134 in the sidewall 102, endwall 104, or bottom 106 of the melt vessel 100. The figures illustrate various types and arrangements of the inflow and outflow openings. In some cases, as shown in FIG. 5, it is preferable that the inflow opening 132 and outflow opening 134 be symmetrically positioned with respect to a centerline between the sidewalls 102. In other cases, as shown in FIGS. 2 and 6, it may be preferable to position the inflow opening 132 and outflow opening 134 asymmetrically with respect to the centerline between the sidewalls. Other combinations are also possible, as shown in FIG. 9, illustrating nonparallel sidewalls 102, a symmetrically positioned inflow opening 132, and an asymmetrically positioned outflow opening 134. Where the oxide is to be herded into the trap, for example, placing the inflow opening 132 nearer to the sidewall 102 where the trap region 116 is located, as for example, in FIG. 6, may facilitate herding of oxide into the trap both by natural currents and by manipulation of the heating source.

The present approach is effective for removing oxides and other floating material from the surface of melts, prior to the metal of the melt being sent to an atomizer. This invention has been described in connection with specific embodiments and examples. However, it will be readily recognized by those skilled in the art the various modifications and variations of which the present invention is capable without departing from its scope as represented by the appended claims.

What is claimed is:

1. Apparatus for producing solidified metals of high cleanliness, comprising:

a melt vessel having walls with cooling passages therein and having first and second opposing sidewalls;

a dam extending from the first sidewall of the melt vessel at an acute angle thereto, the dam extending above a preselected level of the interior of the vessel to form a floating matter trap region within the apex of the acute angle, and having a passageway therethrough sufficiently remote from the trap region that floating matter in the trap region is not in communication with the passageway so that floating matter cannot pass around the dam through the passageway;

means for producing solidified metal; and means for transferring molten metal from the melt vessel to the means for producing solidified metal.

2. The apparatus of claim 1, wherein the melt vessel further includes a floating matter receptacle communicating with the trap region.

3. The apparatus of claim 2, wherein the floating matter receptacle communicates with the trap region via a notch in the first sidewall of the vessel.

4. The apparatus of claim 1, wherein the dam is a metal piece having cooling passages therethrough.

5. The apparatus of claim 1, wherein the dam extends from the first sidewall to the second sidewall.

6. The apparatus of claim 4, wherein the dam is substantially straight in a plan view, and intersects the second sidewall at an obtuse angle.

7. The apparatus of claim 1, wherein the upper surface of the dam is substantially straight in a plan view.

8. The apparatus of claim 1, wherein the upper surface of the dam has a V-shape formed from two intersecting legs in a plan view, one leg meeting the first sidewall at an acute angle and the other leg meeting the second sidewall at an acute angle.

9. The apparatus of claim 1, wherein the acute angle is about 60 degrees.

10. The apparatus of claim 1, wherein the sidewalls of the vessel are not parallel in a plan view.

11. The apparatus of claim 1, wherein the passageway through the dam is below the preselected level within the interior of the vessel.

12. The apparatus of claim 1, wherein the passageway through the dam is at the preselected level within the interior of the vessel, but remote from the trap region along the upper surface of the dam.

13. The apparatus of claim 1, wherein the means for producing solidified metal is a metal powder producer.

14. Apparatus for producing solidified metals of high cleanliness, comprising:

a melt vessel having walls with cooling passages therein and having first and second opposing sidewalls, the vessel walls having a metal inflow opening and a metal outflow opening therethrough;

a dam extending from the first sidewall of the vessel at an acute angle thereto and forming two volumes within the vessel, an inflow volume in communication with the inflow opening of the vessel and an outflow volume in communication with the outflow opening of the vessel, the dam extending above a preselected level of the interior of the vessel to form a floating matter trap region within the apex of the acute angle and within the inflow volume, and having a passageway therethrough sufficiently remote from the trap region that floating matter in the trap region is not in communication with the passageway so that floating matter cannot pass around the dam through the passageway;

means for producing solidified metal; and means for transferring molten metal from the melt vessel to the means for producing solidified metal.

15. The apparatus of claim 14, wherein at least one of the inflow opening and the outflow opening is asymmetrically positioned with respect to a longitudinal centerline between the sidewalls.

16. A method for producing solidified metal having high cleanliness, comprising:

introducing metal into a first end of a melt vessel, the melt vessel further having a second end, oppositely disposed sidewalls with cooling passages, and a dam extending from a first sidewall of the melt vessel at an acute angle thereto and at least partially across the melt vessel toward the opposing sidewall thereby forming a trap region;

heating the metal with a heating source to a temperature at which the metal is molten;

flowing the molten metal from the first end of the melt vessel to the second end of the melt vessel;

capturing impurities floating on the surface of the molten metal in the trap region so that the impurities cannot pass the dam as the molten metal flows from the first end past the trap region to the second end;

maintaining the flowing metal in a molten state with a heating source as it flows from the first end past the dam to a second end;

discharging the molten metal from the second end of the melt vessel; and solidifying the molten metal.

17. The method of claim 16 wherein the step of introducing metal includes flowing a stream of molten metal from a melt source into the melt vessel.

18. The method of claim 16 further including the step of removing the captured impurities from the trap region into a receptacle.

19. The method of claim 16 wherein the step of capturing impurities includes capturing oxide impurities.

20. The method of claim 16 wherein the step of capturing floating impurities includes herding the floating impurities toward the trap region with the heating source.

21. The method of claim 20 wherein the heating source is a plasma torch.

22. The method of claim 20 wherein the heating source is an electron beam source.

23. The method of claim 16 wherein the step of flowing the metal from the first end to the second end further includes moving the molten metal past the dam through a passageway sufficiently remote from the trap region so that the floating impurities do not flow from the trap region to the passageway.

24. The method of claim 16 wherein the step of solidifying the discharged molten metal from the melt vessel includes pouring a stream of molten metal into a powder producing device.

25. The method of claim 16 wherein the step of solidifying the discharged molten metal from the melt vessel includes casting the molten metal into an ingot.

* * * * *